United States Patent [19]

Brady et al.

[11] 4,365,185

[45] Dec. 21, 1982

[54] MAGNETRON HAVING THREE ALTERNATINGLY CONNECTED STRAPS

[75] Inventors: Michael B. C. Brady, Maldon; Michael L. Goddard, Birmingham, both of England

[73] Assignee: English Electric Valve Company Limited, Chelmsford, England

[21] Appl. No.: 167,843

[22] Filed: Jul. 14, 1980

[30] Foreign Application Priority Data

Jul. 14, 1979 [GB] United Kingdom ..... 7924590

[51] Int. Cl.[3] ..... H01J 23/22

[52] U.S. Cl. ..... 315/39.69; 315/39.51

[58] Field of Search ..... 315/39.69, 39.51

[56] References Cited

U.S. PATENT DOCUMENTS

| | | | |
|---|---|---|---|
| 2,546,870 | 3/1951 | Sayers | 315/39.69 |
| 2,808,538 | 10/1957 | Cutler | 315/39.69 X |
| 3,121,822 | 2/1964 | Boyd | 315/39.69 |
| 3,176,188 | 3/1965 | Wilbur | 315/39.69 |
| 3,437,875 | 4/1969 | Farney | 315/39.69 X |
| 3,536,953 | 10/1970 | Van De Goor | 315/39.69 |

*Primary Examiner*—Saxfield Chatmon, Jr.

*Attorney, Agent, or Firm*—Spencer & Kaye

[57] ABSTRACT

The invention provides a magnetron of the strapped anode type having three strapping members each coaxial but at different diameters from the center of the anode block of the magnetron. The middle strapping member is connected to alternate vanes and the innermost and outermost strapping members are connected to the remaining ones of the anode vanes.

3 Claims, 2 Drawing Figures

MAGNETRON HAVING THREE ALTERNATINGLY CONNECTED STRAPS

BACKGROUND OF THE INVENTION

This invention relates to magnetrons and in particular to so-called strapped magnetrons of the kind in which vanes extend radially inwards from the general cylindrical wall of the anode block of the magnetron and alternate ones of the vanes are connected together by so-called straps.

The anode assembly of a typical known strapped magnetron is illustrated in FIG. 1 of the accompanying drawing. Referring to FIG. 1 the magnetron anode assembly consists of an anode block 1 of general cylindrical form having a plurality in this case 12, of vanes 2 to 13 extending radially inwards towards the cathode region 14 of the magnetron. Two straps 15 and 16 are provided. Inner strap 15 is connected to vanes 2, 4, 6, 8, 10 and 12, outer strap 16 is connected to vanes 3, 5, 7, 9, 11 and 13. As well known slots are cut into the vanes where a strap is required to pass without making electrical connection.

With certain types of magnetron as described in FIG. 1 a net loss of power has been experienced due it is believed to power being coupled into the cathode.

SUMMARY OF THE INVENTION

An object of the present invention is to reduce this above-stated effect.

According to this invention a magnetron of the strapped anode type is provided comprising an anode block having a plurality of radial vanes extending therewithin and three strapping members each co-axial but at different diameters from the center of said anode block, said middle strapping member being connected to alternate vanes and said innermost and outermost strapping members being connected to the remaining ones of said anode vanes.

Normally said middle strapping member is located midway between said innermost and said outermost strapping members.

The effect of the present invention is that electrically the connection of the innermost and outermost strapping members to the same vanes appears to correspond to the effect of providing a single strapping member in the median position which is physically occupied by the middle strapping member connected to the other set of alternate vanes. It is this improvement in symmetry which is believed to account for an improvement in net power which has been experienced with certain types of magnetron. Whether the explanation for this improvement is correct or not, however, the improvement has been experienced and the sufficiency of the present specification does not rely upon the correctness or otherwise of this explanation.

DETAILED DESCRIPTION OF THE PREFERRED EMBODIMENTS

The invention is further described with reference to FIG. 2 of the accompanying drawing which illustrates the anode assembly of one magnetron in accordance with the present invention. In FIG. 2 like references are used for like parts in FIG. 1.

Figure 1:
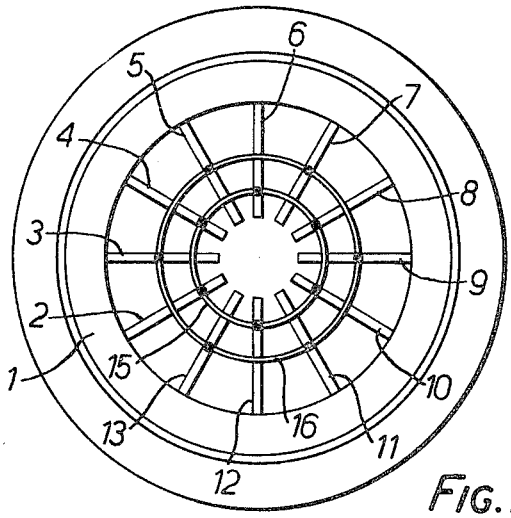
FIG. 1 is a schematic illustration of a prior art magnetron.
Figure 2:
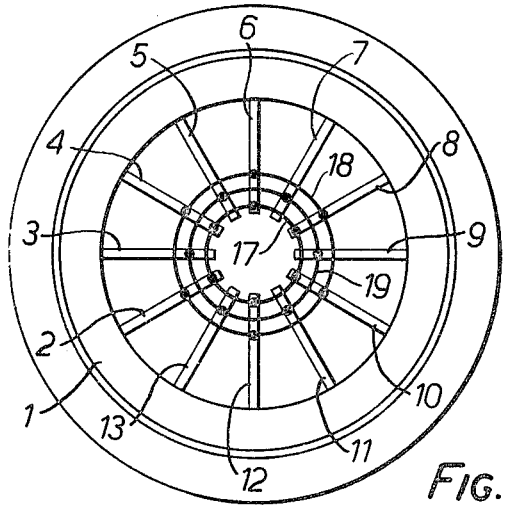
FIG. 2 is a schematic illustration of a magnetron according to the invention.

As will be seen the principal difference between the anode assembly of FIG. 2 and the anode assembly of FIG. 1 is that in FIG. 2 three co-axial strapping members are provided, the innermost strapping member is referenced 17, the outermost strapping member is referenced 18 and the middle or median spaced strapping member from the centre of the anode block is referenced 19. The middle strapping member 19 is positioned halfway between innermost strapping member 17 and outermost strapping member 18. Innermost strapping member 17 and outermost strapping member 18 are both electrically connected to anode vanes 2, 4, 6, 8, 10 and 12. The middle strapping member 19 is connected to anode vanes 3, 5, 7, 9, 11 and 13.

As with FIG. 1 where a strapping member is required to pass an anode vane without making electrical contact therewith a suitable slot is cut in the vane.

We claim:

1. A magnetron of the strapped anode type comprising an anode block having a plurality of radial vanes extending therewithin and three strapping members each co-axial but at different diameters from the center of said anode block, said middle strapping member being connected to alternate vanes and said innermost and outermost strapping members each being connected to all of the remaining ones of said anode vanes.

2. A magnetron as claimed in claim 1 and wherein said middle strapping member is located midway between said innermost and said outermost strapping members.

3. A magnetron as claimed in claim 1, wherein said vanes connected to said middle strapping member constitute a first series of vanes and said remaining ones of said vanes connected to said innermost and outermost strapping members constitute a second series of vanes.

* * * * *